United States Patent [19]

Beechen

[11] 4,245,443

[45] Jan. 20, 1981

[54] SEEPAGE CONTROL DEVICE

[76] Inventor: Paul R. Beechen, 16410 Beverly Ave., Tinley Park, Ill. 60477

[21] Appl. No.: 40,600

[22] Filed: May 18, 1979

[51] Int. Cl.[3] ..... E04B 1/70; E04F 17/00

[52] U.S. Cl. ..... 52/169.5; 52/305

[58] Field of Search ..... 52/169.5, 302, 303, 52/305

[56] References Cited

U.S. PATENT DOCUMENTS

| | | | |
|---|---|---|---|
| 2,106,516 | 1/1938 | Cheney | 52/302 |
| 2,122,926 | 7/1938 | Blacher | 52/305 |
| 2,163,286 | 6/1939 | Munro | 52/305 |
| 2,948,993 | 8/1960 | Marchi | 52/169.5 |
| 3,654,765 | 4/1972 | Munro et al. | 52/169.5 |
| 3,656,268 | 4/1972 | Murati | 52/ |
| 3,852,925 | 12/1974 | Gazzo | 52/169.5 |
| 4,075,800 | 2/1978 | Molick | 52/303 |

*Primary Examiner*—James L. Ridgill, Jr.

*Attorney, Agent, or Firm*—Gary, Juettner & Pyle

[57] ABSTRACT

An arrangement for preventing seepage through a wall from running onto the poured concrete floor of a basement or the like, comprises a vertical channel member positioned between the wall and the floor and having spaced flat surfaces spaced from the wall, and a water impermeable facing strip abutting the flat surfaces which are spaced from the wall and against which the concrete floor is poured. A horizontal channel member has spaced flat surfaces abutting a footing which supports the walls, and alternate spaced flat surfaces spaced from the footing. The concrete floor is poured directly on the horizontal channel member.

4 Claims, 4 Drawing Figures

SEEPAGE CONTROL DEVICE

BACKGROUND OF THE INVENTION

The most common cause of water problems in basements, or in below-grade family rooms and bedrooms as frequently built in the lower levels of bi-level type homes, is seepage from the outside which passes through cracks in the foundation walls and runs onto the floor. Attempting to seal such cracks, either from the inside or from the outside, is not only very costly but generally is also ineffective.

As a consequence, many other ways of solving the problem have been devised, but none of these have proved to be particularly practicable, usually because of the high cost and the difficulty of installation. In the U.S. Pat. to Munro, No. 2,163,286, for example, a strip of flexible material is embedded in the masonry during construction of the building wall, while the masonry is in a plastic state, and the strip is withdrawn when the masonry is partly set so as to leave an unobstructed channel opening to the exterior of the wall in the place originally occupied by the strip. This construction is not only costly and time consuming to fabricate but the openings tend to become plugged, thus reducing their effectiveness. Further, the system will not remove seepage which passes through the wall by way of cracks which subsequently develop.

Various types of flashing have been developed, such as disclosed in Blacher U.S. Pat. No. 2,122,926 and Doing U.S. Pat. No. 2,154,734, but, while these may be somewhat effective to prevent downward seepage through the cement or motor joints, they are not effective to prevent lateral seepage through the wall from outside or inside.

Healy et al U.S. Pat. No. 3,654,765 discloses a below-grade or subterranean wall drain positioned against the exterior wall of a building. The drain would not be effective to prevent seepage through cracks which might develop in the wall at a level above the top of the drain unit.

Murati U.S. Pat. No. 3,656,268 relates primarily to permeable wooden cofferdams for open excavations, intended to guide water which seeps therethrough to a drainage system. The arrangement utilizes a flexible, water-impermeable membrane to conduct water to vertical conduits which then conduct the water to a horizontal conduit. Murati could not possibly accomplish the objective attained by Applicant's device namely, preventing seepage through random cracks in a building wall from flowing onto a floor which is at a level below the level of the cracks.

Marchi U.S. Pat. No. 2,948,993 utilizes vertically positioned elongated sheets of plastic or Masonite, one face of which is in contact with a concrete floor. The sheets are held away from the walls by a plurality of spacers, thereby forming vertical drain passages leading downwardly directly into a bed of gravel. It will be noted, first, that no direct horizontal passages are provided to faciliate run-off of seepage under the floor and, second, the Marchi construction is expensive and time consuming to fabricate.

Gazzo U.S. Pat. No. 3,852,925 is intended primarily to control seepage through paneled walls formed of hollow blocks. Granular material such as gravel is piled against the wall and on top of a footing supporting the wall. Next, a generally "L" shaped piece of plastic is placed over and against the gravel and is taped to the paneling, after which the concrete floor is poured to hold the plastic in place. The Gazzo arrangement may be utilized only in conjunction with a paneled wall and appears to be impracticable because (a) there is no suggested way to support the gravel until the plastic is positioned and (b) there is no suggested way to support the plastic against the pressure exerted by the gravel until the concrete is poured.

While the foregoing prior art devices suggest various systems for controlling seepage, none suggest a simple, inexpensive; yet effective, commercially feasible, system for solving the problem.

SUMMARY OF THE INVENTION

Applicant has overcome the problems inherent in prior art devices by the provision of an inexpensive, easily fabricated seepage control system which, in its broadest sense, provides discrete vertical channels between the lower portion of a wall and a concrete floor and also discrete horizontal channels between a wall footing and the concrete floor. The system comprises a vertical leg or channel member and a horizontal leg or channel member fabricated from an elongated water impervious sheet, preferably plastic, formed with alternate, flat-topped ridges and flat valleys substantially parallel thereto. The flat valleys of the horizontal leg rest on the footing and the concrete floor is poured directly onto the leg. The flat valleys of the vertical leg abut the building wall while a planar facing strip is positioned so as to abut the flat tops of the ridges. The concrete floor abuts the facing strip which preferably extends to a level above the level of the floor.

The horizontal channel member and the vertical channel member may be separate pieces but, preferably, are formed as a single unitary structure as will be explained hereafter. The channel members may be made to any convenient length and, in practice, a plurality of members in end-to-end abutting relationship will be utilized around the perimeter of a room.

DESCRIPTION OF THE PREFERRED EMBODIMENTS

Figure 1:
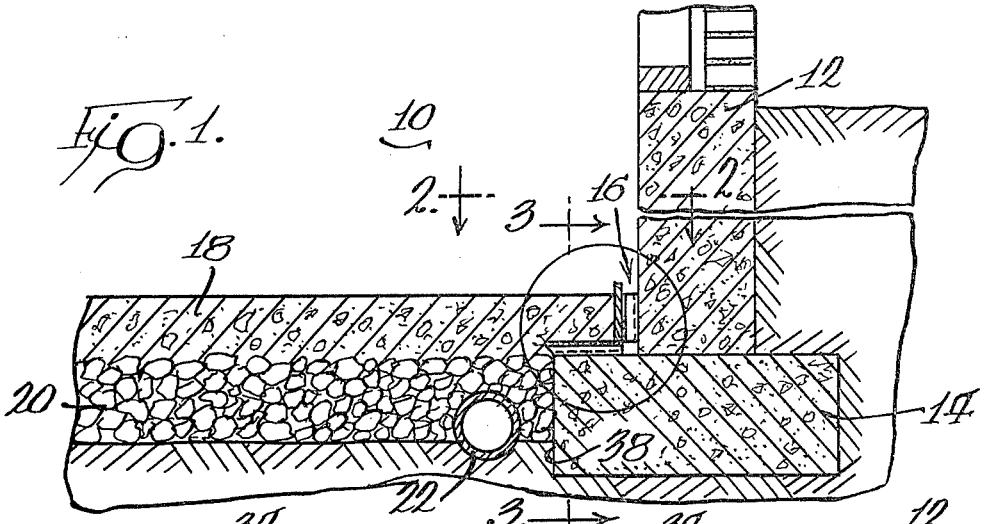
FIG. 1 is a fragmentary vertical sectional view of the seepage control system of the present invention as installed in a below-grade living area of a building.
Figure 2:
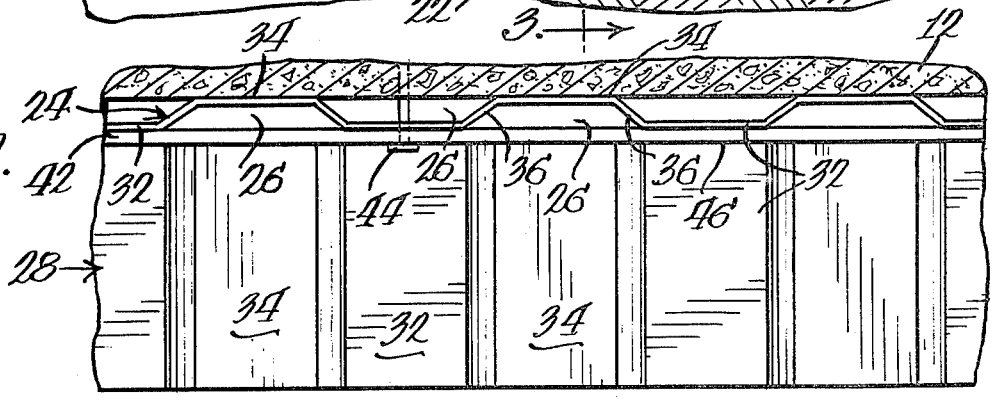
FIG. 2 is a sectional view taken substantially along line 2—2 of FIG. 1.
Figure 3:
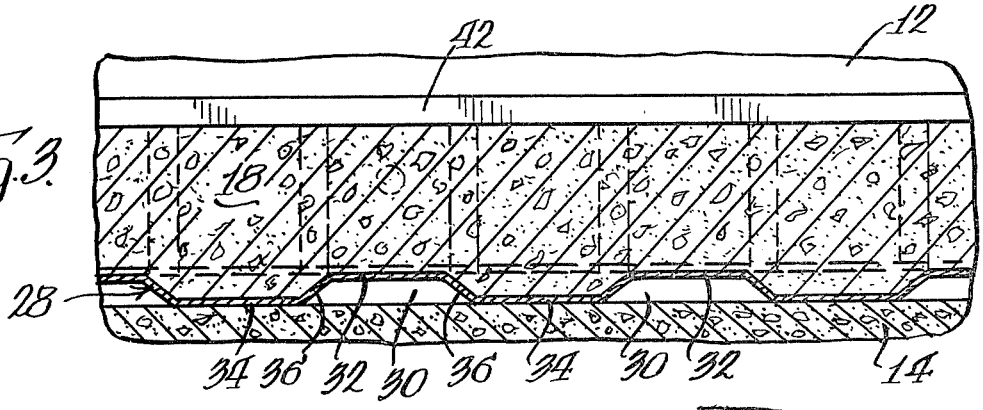
FIG. 3 is a sectional view taken substantially along lines 3—3 of FIG. 1.
Figure 4:
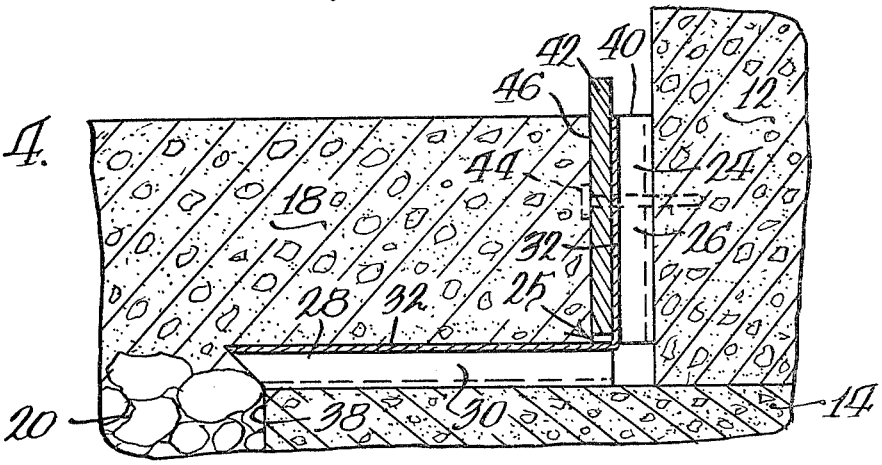
FIG. 4 is an enlarged view of the circled portion of FIG. 1.

Referring to FIG. 1 of the drawings, a corner portion of a basement or other below-grade living area is designated generally at 10 and includes a foundation wall 12 extending below the ground level 13 and resting upon a footing 14. The seepage control system of the present invention, which will be described in detail with reference to FIGS. 2, 3 and 4, is indicated generally at 16 and is positioned respectively between the side wall and footing and a poured concrete floor 18 which rests on a water permeable gravel bed 20. One or more conventional drain tiles 22 communicate with a sump pump (not shown).

Referring to FIGS. 2 through 4, the seepage control system 16 comprises a rigid, water impermeable vertical member 24 defining drainage channels 26 and a rigid, water impervious horizontal member 28 defining drainage channels 30. The members 24 and 28 may be formed as separate pieces or may be formed from a single sheet or panel, slit partially through so as to be folded to form a vertical leg and a horizontal leg of a unitary structure 25, as seen in FIG. 4.

As best seen in FIGS. 2 and 3, the members 24 and 28 each comprise an elongated panel or sheet having sequential transverse ridges 32 and valleys 34, the tops of the ridges and the bottoms of the valleys being flat and preferably parallel to each other. The flat bottoms of the valleys of the vertical member 24 abut the foundation wall 12 while the flat bottoms of the horizontal member 28 abut the footing 14. For ease of fabrication and also to facilitate the later pouring of the concrete floor, the valleys 34 are connected to the ridges 32 by walls 36 diverging in a direction away from the individual valleys.

Members, or drainage panels, 24 and 28 may be molded, extruded, or formed from sheet stock, provided that they are reasonably rigid and are water impermeable. Preferably they may comprise a thermoplastic polymer such as polyethylene but other materials may be utilized such as fiberglass reinforced resin, polypropylene, rubber, aluminum, or the like. The preferred thickness, depending obviously on the material, is about 1/32 to about 1/16 inches.

As stated earlier, members 24 and 28 may be formed separately but preferably, they are formed from a single sheet 25, first shaped to provide the transverse ridges and valleys and then slotted and creased to form a 90° angle. For convenience in shipping, the drainage panels 25 may be formed, slotted and creased in manufacture, shipped flat and bent to a 90° angle in the field.

As seen in FIGS. 3 and 4, the concrete floor 18 is poured directly onto the horizontal member 28 (or horizontal leg if the panel is a unitary structure) which extends away from the foundation wall 12 at least to the inner surface 38 of the footing 14. The upper edge 40 of the vertical member or leg 24 may terminate at or slightly below the surface of the floor 18 and preferably is provided with a water impermeable rubber, plastic or asphalt impregnated facing strip 42 which abuts the ridges 32. The facing strip 42 together with the vertical member 24 are preferably secured to the foundation wall by a plurality of masonry nails 44. The horizontal member 28 may be similarly secured to the footing but generally it is not necessary to do so, particularly when the members 24 and 28 are formed as part of a unitary structure. It will be understood that the unitary drainage panels 25, or separate members 24 and 28 may be made to any convenient length and a sufficient number of them placed in end to end abutting relationship so as to protect one or more walls of a subterranean room. The facing strip 42 may similarly be furnished in convenient short lengths but, if made from a rubber base material, could be furnished in one piece from a continuous roll.

When the drainage members are in place, the concrete floor 18 is poured so as to extend over the horizontal member 28 and against the outer surface 46 of the facing strip 42. The facing strip 42 extends above the level of the top of the floor to prevent overflow of seepage water onto the floor and also to prevent dirt and the like from being swept from the floor into the drainage channels.

It is seen, then, that the seepage control system, in its preferred form, comprises a vertical channel member having first sequentially spaced flat surfaces abutting the foundation wall; second sequentially spaced flat surfaces arranged alternately with said first surfaces and parallel thereto; walls interconnecting adjacent surfaces; and a facing strip abutting the second flat surfaces. The concrete floor is poured against the facing strip. The system also comprises a similar horizontal channel member, constructed in the same manner as the vertical channel member or, alternatively, being integral therewith. The first sequential flat surfaces of the horizontal channel member abut the foundation wall footing while the concrete floor is poured directly onto the member.

The above-described construction is easier and less expensive to fabricate and to install than prior art seepage control systems, which have proven to be impracticable from a commercial standpoint.

While the preferred embodiment has been illustrated and described herein, it is to be understood that various modifications may be made therein without departing from the scope of the invention, as defined by the appended claims.

What is claimed is:

1. A seepage control arrangement for preventing seepage water from running over the floor of basements or the like which include vertical side walls resting on a transverse footing, a portion of which extends inwardly from each respective side wall, and a poured concrete floor, the arrangement comprising: a plurality of contiguous unitary structures, each structure including a vertical leg defining sequential vertical drainage channels between the floor and the walls, and a horizontal leg defining sequential horizontal drainage channels between the floor and the footing, each horizontal drainage channel communicating with a corresponding vertical drainage channel to afford egress for water seeping through the walls and to conduct the water beneath the floor, and a separate flat, water impermeable facing strip positioned between the floor and the vertical leg and extending to a height above the height of the vertical leg and the floor to prevent overflow of seepage water onto the floor.

2. The arrangement of claim 1, wherein the contiguous drainage channel structures comprise a plurality of sections in end-to-end abutting relationship, and the facing strip comprises a separate continuous unitary flexible strip.

3. The arrangement of claim 1, wherein the horizontal and vertical legs defining the drainage channels comprise two legs, at right angles to each other, of separate structures.

4. The arrangement of claim 1, wherein said unitary structures comprise elongated, rigid panels having sequential, transverse interconnected ridges and valleys, the bottoms of the valleys and the tops of the ridges being flat, the flat valleys of the vertical leg being disposed to abut the side walls, and the flat valleys of the horizontal leg being disposed to abut the footing, the flat ridges of said legs being spaced from the side walls and footing respectively so as to form therewith said drainage channels.

* * * * *